US006487726B1

(12) United States Patent
Sitiku

(10) Patent No.: US 6,487,726 B1
(45) Date of Patent: Dec. 3, 2002

(54) MITT FOR THE MASSAGE

(76) Inventor: Yosio Sitiku, 1-15-11 A301, Suwada, Ichikawa-shi, Chiba (JP)

( * ) Notice: Subject to any disclaimer, the term of this patent is extended or adjusted under 35 U.S.C. 154(b) by 0 days.

(21) Appl. No.: 08/999,633

(22) Filed: Mar. 5, 1998

(51) Int. Cl.[7] ..... A41D 19/00
(52) U.S. Cl. ..... 2/159; 2/158
(58) Field of Search ..... 2/158, 159, 20, 2/21, 160, 161.1, 161.2, 161.3, 161.4, 161.5, 161.6, 161.7, 161.8, 162, 163, 164, 165, 166, 167, 168, 169; 15/227

(56) References Cited

U.S. PATENT DOCUMENTS

| | | | | | |
|---|---|---|---|---|---|
| 320,856 | A | * | 6/1885 | Dillon | 2/20 X |
| 405,295 | A | * | 6/1889 | Bailey | 2/20 X |
| 415,026 | A | * | 11/1889 | Cowen et al. | 2/20 X |
| 804,680 | A | * | 11/1905 | Smith | 2/20 X |
| 1,413,967 | A | * | 4/1922 | Clarke | 2/158 X |
| 2,068,182 | A | * | 1/1937 | Jackson | 2/20 |
| 2,075,413 | A | * | 3/1937 | Welker | |
| D115,171 | S | * | 6/1939 | O'Leary | D28/63 |
| 4,308,860 | A | * | 1/1982 | Sanders et al. | 128/62 R |
| 4,577,625 | A | * | 3/1986 | Lohati et al. | 601/128 |
| 4,893,955 | A | * | 1/1990 | Zielinski | 401/7 |
| D347,709 | S | * | 6/1994 | Pearson | D24/200 |
| 5,419,014 | A | * | 5/1995 | Piantedosi | 2/161.8 X |
| 5,720,048 | A | * | 2/1998 | Perez | 2/161.8 X |
| 5,765,252 | A | * | 6/1998 | Carr | 15/104.94 |
| 5,779,653 | A | * | 7/1998 | Thompson | 601/136 |

FOREIGN PATENT DOCUMENTS

| | | | | |
|---|---|---|---|---|
| BE | 496124 | * | 10/1950 | 2/20 |
| FR | 1367488 | * | 6/1964 | 2/161.6 |
| GB | 2035052 | * | 6/1980 | 2/161.6 |

* cited by examiner

*Primary Examiner*—Gary L. Welch

(57) ABSTRACT

The present invention is a massage tool comprised of a flexible mitt-shaped sheet, made of plastic or rubber, which has a separate thumb portion and numerous projections that are specially shaped and spaced to ensure flexibility while massaging, allowing comfortable pushing, patting and pinching throughout the surface of the flexible sheet, and a fastening device on the back that can be easily cleaned, attached or removed.

1 Claim, 1 Drawing Sheet

MITT FOR THE MASSAGE

BACKGROUND OF THE INVENTION

The present invention relates to a massage tool that is comprised of a flexible mitt-shaped sheet, made of plastic or rubber, which has a separate thumb portion and numerous projections on its front surface, and a fastening device on the back.

Massage tools having many projections have been used for body massage, excluding the scalp. A massage tool designed for the scalp was therefore sought.

For scalp massage, some conventional massage tools, which are in the form of gloves, mittens and the like, are impracticable for the following reasons:

1) The length of the projections are too short and cannot reach the scalp.
2) The diameter of the projections are too thick and the shape of the projection tips are too flat, resulting in the hair being caught between the scalp and projections.
3) The length/diameter ratio of the projections are too large; thus projections do not possess sufficient rigidity to grip the scalp.
4) The projections are spaced too closely together meaning that the flexible sheet cannot easily follow the hand's movements.

Cleaning, attaching or removing these massage tools are cumbersome in that some conventional massage tools have a suction portion that collects rubbish, the opening of which is often too narrow to insert one's hand or finger.

For massage of a wide area of the scalp in a short time some conventional massage tools do not possess sufficient flexibility to follow comfortably the hand's movements or the shape of the head, and the area of projections is insufficient to cover the scalp.

The invention was created to improve upon such drawbacks contained in conventionally used massage tools.

SUMMARY OF THE INVENTION

The present invention is a massage tool comprised of a flexible mitt-shaped sheet, made of plastic or rubber, which has a separate thumb portion and numerous projections, which are specially shaped and spaced to ensure flexibility while massaging, allowing comfortable pushing, patting and pinching throughout the surface of the flexible sheet, and the fastening device on the rear can be easily cleaned, attached or removed.

BRIEF DESCRIPTION OF THE DRAWINGS

The envisioned form of the present invention is illustrated with the accompanying drawings in which.

Figure 1:
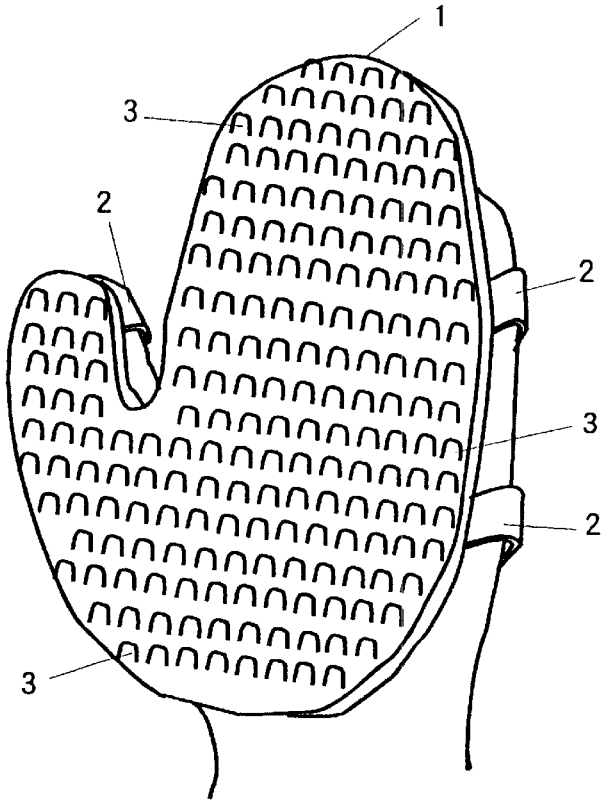
FIG. 1 is the proposed frontal view of this invention.
Figure 2:
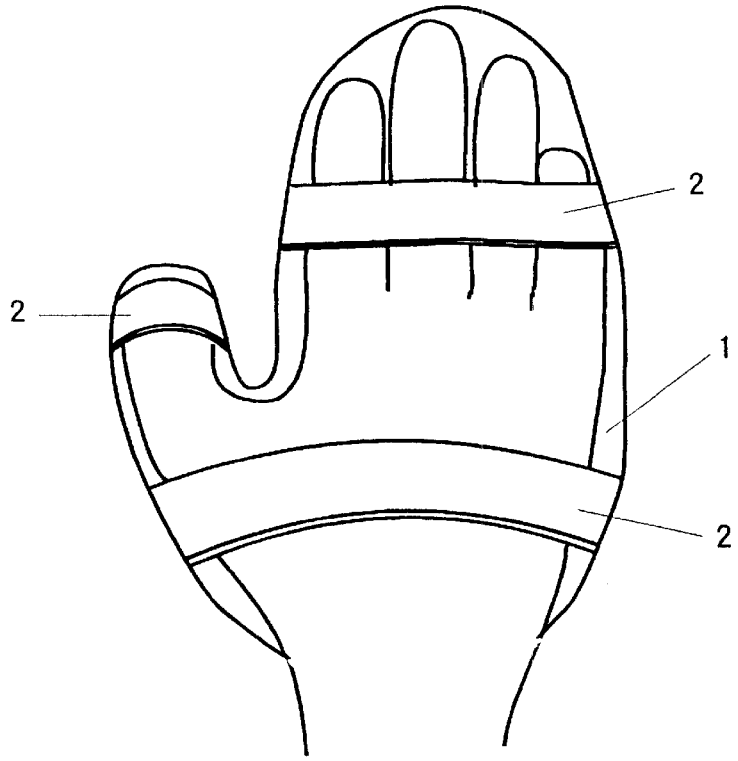
FIG. 2 is a back view.

(number 1, the flexible sheet; number 2, the fastening device; number 3, projections)

DETAILED DESCRIPTION OF THE INVENTION

The details of the present invention are as follows.

(1) A Flexible Sheet

A mitt-shaped flexible sheet (1) made of either plastic or rubber with a separate thumb section designed to massage in a pinching way and fitted with numerous projections (3) on its front face to efficiently massage a wide area of the scalp.

(2) Fastening Device

A fastening device (2) of separate straps and the like on the back, which can be easily cleaned, attached or removed.

(3) Projections

The projections (3), molded with rounded tips, are 1 to 7 mm in length and have a length/diameter ratio of 1 to 2, which extend from the sheet (1) at 2 to 10 mm intervals, both to protect and grip the scalp.

What is claimed is:

1. A massage tool for massaging a user's scalp comprised of a flexible mitt-shaped sheet having a front and back surface made of plastic or rubber, with a separate thumb portion and numerous projections disposed throughout said front surface at 2 to 10 mm intervals to ensure flexibility for allowing comfortable pushing, patting and pinching of said scalp, wherein the numerous projections are molded with rounded tips that are 1 to 7 mm in length to prevent the user's hair from being caught between said scalp and said projections and having a length/diameter ratio of 1 to 2 to ensure sufficient rigidity to grip said scalp and a removable fastening device disposed on the said back surface of the mitt for facilitating easy cleaning and attaching and removing of said tool.

* * * * *